US007625455B2

(12) United States Patent
Axelsson et al.

(10) Patent No.: US 7,625,455 B2
(45) Date of Patent: Dec. 1, 2009

(54) METHOD OF HEAT TREATMENT OF STAINLESS STEEL

(75) Inventors: Carl-Lennart Axelsson, Tungelsta (SE); Tomas Ekman, Saltsjö-Boo (SE); Ola Ritzén, Åkersberga (SE)

(73) Assignee: Linde AG, Höllriegelskreuth (DE)

( * ) Notice: Subject to any disclaimer, the term of this patent is extended or adjusted under 35 U.S.C. 154(b) by 709 days.

(21) Appl. No.: 10/504,673

(22) PCT Filed: Feb. 17, 2003

(86) PCT No.: PCT/SE03/00259

§ 371 (c)(1),
(2), (4) Date: Feb. 1, 2005

(87) PCT Pub. No.: WO03/070992

PCT Pub. Date: Aug. 28, 2003

(65) Prior Publication Data

US 2005/0115648 A1 Jun. 2, 2005

(30) Foreign Application Priority Data

Feb. 22, 2002 (SE) ..... 0200532

(51) Int. Cl.
*C21D 1/08* (2006.01)

(52) U.S. Cl. ..... 148/605; 148/597; 148/625; 148/633; 148/712; 148/663; 432/11; 432/128; 432/133

(58) Field of Classification Search ..... 148/597, 148/625, 655, 633, 712, 605, 663; 432/11, 432/128, 133
See application file for complete search history.

(56) References Cited

U.S. PATENT DOCUMENTS

| | | | | |
|---|---|---|---|---|
| 5,360,202 | A * | 11/1994 | Adachi | 266/103 |
| 5,783,000 | A * | 7/1998 | Axelsson et al. | 148/605 |
| 6,183,246 | B1 * | 2/2001 | Le Goueffec | 432/128 |
| 6,652,681 | B2 * | 11/2003 | Delabroy et al. | 148/663 |

FOREIGN PATENT DOCUMENTS

WO WO 95/24509 9/1995

* cited by examiner

*Primary Examiner*—Roy King
*Assistant Examiner*—Jie Yang
(74) *Attorney, Agent, or Firm*—Alfred J. Mangels

(57) ABSTRACT

A method of heat treating stainless steel in the form of blanks, piping, tubing, strip, or wire-like material, after rolling the material, and in a heat treatment furnace at a temperature higher than about 900° C. The material is subjected to a preheating stage and a final heating stage, wherein in the preheating stage flames from burners are directed toward the surface of the material to impinge on the surface. Burners situated in the preheating stage are supplied with a fuel that burns with the aid of an oxidizing gas that contains gaseous oxygen. The material is held in the preheating stage long enough to obtain at least some degree of oxidation on the surface of the material, and the material is heated further in a following, final heating stage by burners situated in a furnace and that are supplied with a fuel and an oxidizing gas.

4 Claims, 2 Drawing Sheets

METHOD OF HEAT TREATMENT OF STAINLESS STEEL

BACKGROUND OF THE INVENTION

1. Field of the Invention

The present invention relates to a method of heat treating stainless steel.

2. Description of the Related Art

European Patent Specification No. 0 804 622 teaches a method of heat treating stainless steel that is highly beneficial with respect to conventional techniques.

That earlier specification relates to the heat treatment of stainless steel in the form of piping, tubing, strip material, or wire material, such as strip material, sheet, wire, or rods, after rolling the material, and at a temperature higher than about 900° C. in a furnace or oven. According to that invention, the burners provided in the furnace are driven with a liquid or gaseous fuel which is caused to combust with the aid of a gas that contains at least 85% by volume oxygen and at maximum 10% by volume nitrogen.

This known invention generates during the combustion process a flue gas that contains essentially water and carbon dioxide. The amount of heat that radiates from the flue gas to said material is much greater than the heat radiated from a flue gas that is the product of a combustion process in which air is used as an oxidant. The heat transferred by radiation is the dominant heat transfer in such a heat treatment process.

This greater transfer of heat significantly shortens the time taken to heat the material in the furnace, therewith enabling the rate at which said material is fed into a given furnace to be greatly increased.

Moreover, it was found that the oxide scale formed on the material surface when heated is thinner and can be dealt with more easily, owing to the fact that the scale has a structure which differs from the structure of the scale that forms when the material is heated in a furnace with a conventional air-based flue gas. The pickling time, i.e., the residence time of the material in a following acid and/or electrolyte bath, can be shortened due to the thinner oxide scale.

With the method according to that patent specification a thin oxide scale is thus formed, which remains relatively bright on the furnace.

One drawback with that method is that the comparatively bright surface of the material counteracts the high heat transfer that could otherwise be achieved by the radiation components in an oxygen-gas-based furnace atmosphere. When practicing the method according to that prior publication, the heat transferred is of the order of 30-150 kW/m$^2$.

The present invention solves this problem and enhances the transfer of heat by radiation.

SUMMARY OF THE INVENTION

The present invention thus relates to a method of heat treating stainless steel in the form of blanks, piping, tubing, strip, or wire-like material, such as strip, sheet, wire, or rods, after rolling the material, and in a heat treatment furnace at a temperature higher than about 900° C. The stainless steel is subjected to a preheating stage and a final heating stage, wherein in the preheating stage the burner flames are directed towards the surface of the material so as to impinge on said material. The burners in the preheating stage are supplied with a liquid or gaseous fuel, which is caused to burn with the aid of an oxidizing gas that contains gaseous oxygen. The exposure time of the material in the preheating stage is sufficiently long to obtain at least some degree of oxidation on the surface of the material. The material is heated further in a following, final heating stage by means of burners situated in a furnace and that are supplied with a liquid or a gaseous fuel and an oxidizing gas.

BRIEF DESCRIPTION OF THE DRAWINGS

The present invention will now be described in more detail, partly with reference to an exemplifying embodiment thereof shown in the accompanying drawings, in which.

DESCRIPTION OF THE PREFERRED EMBODIMENTS

The present invention relates to a method of heat treating stainless steel blanks in the form of piping, tubing, strip, or wire-like materials, such as strip, sheet, wire, or rods, after rolling the material, and in a heat treatment furnace at a temperature higher than about 900° C. In this case, the blanks can have a thickness of up to 400 millimeters.

The inventive method includes a preheating stage and a final heating stage in mutually sequential furnaces. In the preheating stage, the burner flames are directed towards the surfaces of the material, so that the flames will impinge on those surfaces.

The burners present in the preheating stage are supplied with liquid or gaseous fuel that is burned with the aid of a combustion gas that contains oxygen gas. This results in a very high degree of heat transfer, namely a transfer of the order of 500-1500 kW/m$^2$.

The residence time of the material in the preheating stage is sufficiently long to oxidize the surface of the material, at least to a certain degree. The material is then heated further in a following, final heating stage by means of furnace-housed burners that are supplied with a liquid or a gaseous fuel and an oxidizing gas.

The surfaces of said material are oxidized as a result of the very high temperatures that occur locally on said surfaces, wherewith the reactants in the flames react and develop heat at the same time that free oxygen and oxygen radicals in the flame oxidize iron and chromium on the steel surface to form an oxide layer. The layer of oxide thus formed results in a higher surface emission factor compared with that of a non-oxidized or relatively shiny or bright surface. The higher emission factor results in a higher heat yield between the furnace atmosphere and said material.

This means that when the material is pre-heated so as to acquire an oxide layer on its surfaces, the material will be heated more quickly in the final heating stage due to a higher heat yield by radiation, as distinct from the case in respect of the aforesaid prior patent publication where a non-oxidized or relatively bright material is fed into the furnace.

According to a highly preferred embodiment of the invention, the oxidizing gas used in the preheating stage contains at least 85% by volume oxygen. This accelerates oxidation, concurrently with the generation of a flue gas consisting generally of carbon dioxide and water. This flue gas gives a high radiation yield, as described in the aforesaid patent document.

According to a further highly preferred embodiment, the oxidizing gas used in the final heating stage also contains at least 85% by volume oxygen.

This means that heating of the material in the final heating stage will be still quicker than in the case of the process taught by the aforesaid patent document, due to the higher radiation yield afforded by said oxide layer.

The present invention thus enables heating times to be shortened still further.

Figure 1:
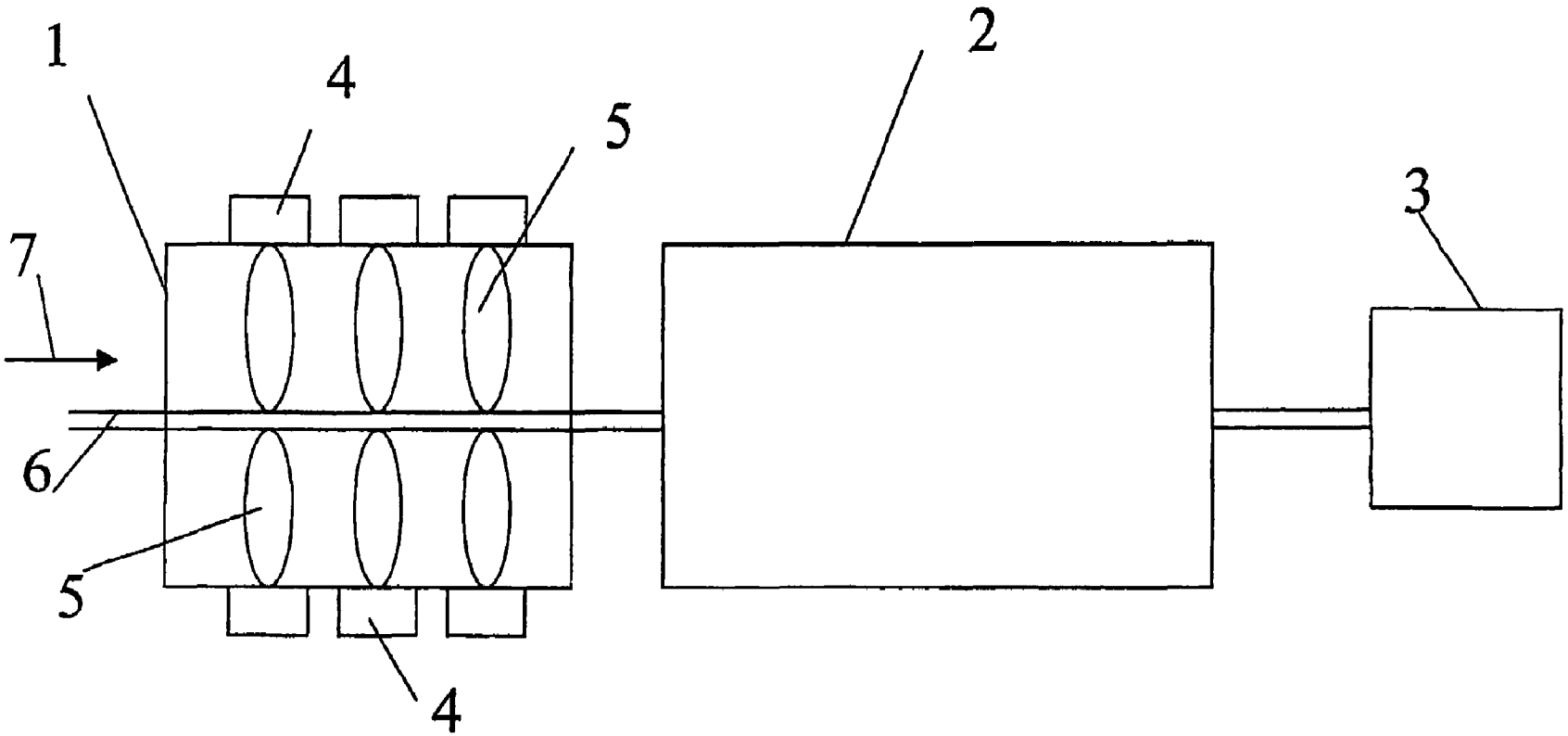
FIG. 1 illustrates schematically a part of a process line.

FIG. 1 illustrates schematically an arrangement for carrying out the inventive method. FIG. 1 shows a preheating stage 1 and a final heating stage 2. The reference numeral 3 identifies one or more subsequent stages, such as a cooling stage, a pickling stage, and so on. The preheating stage includes burners 4. Although not shown in FIG. 1, the final heating stage will, of course, also include burners. The preheating stage 1 and the final heating stage 2 are most often managed so that the product will pass through both stages in the direction of arrow 7. The product is exemplified in FIG. 1 by metal sheet 6. However, the invention can be applied when placing products in and when removing products from said preheating stage and said final heating stage.

As mentioned above, the burner flames 5 are directed towards the surface of the material 6 in the preheating stage, so that the flames will impinge on the surfaces of the material in accordance with the invention, as illustrated in FIG. 1.

According to one preferred embodiment the flames are two-directional so that they will impinge on opposite surfaces of the material, as illustrated in FIG. 1.

Figure 2:
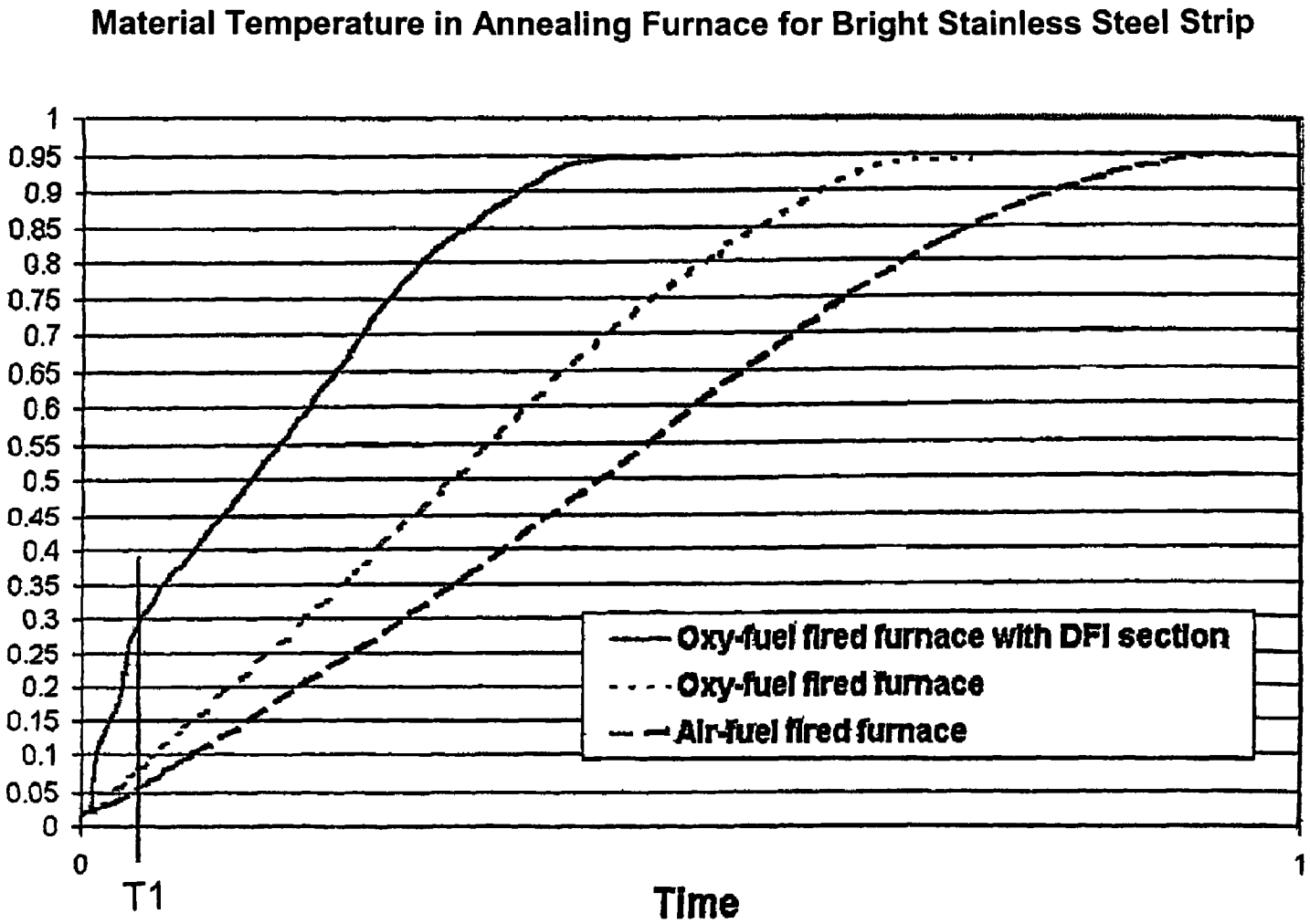
FIG. 2 is a graph of relative material temperature versus time.

FIG. 2 is, in principle, a graph that shows relative temperature curves, where the temperature is plotted against the time at which different material heating operations were carried out. The curves relate to the material temperature of stainless steel strip in an annealing furnace or oven.

The lower, dashed curve shows the temperature of the material in a conventional furnace that lacks a preheating stage, where the bummers burn a liquid or gaseous fuel with air as an oxidizing gas.

The intermediate, dotted curve shows the temperature of the material in a furnace that lacks a preheating stage, where the burners burn a liquid or gaseous fuel with an oxidizing gas that contains 85% by volume oxygen, i.e., a method according to the previously-identified patent.

The full-line curve shows the temperature of the material in a furnace that includes a preheating stage, where the burners burn a liquid or a gaseous fuel with an oxidizing gas that contains 85% by volume oxygen in both the preheating stage and the final heating stage. From time 0 to time T1, the rise in temperature takes place in the preheating stage. Thereafter the rise in temperature takes place in the final heating stage. The preheating stage is thus much shorter than the final heating stage.

According to one preferred embodiment, the material is heated to a temperature of 150-1000° C. in the preheating stage.

In the final heating stage the material can be heated to a temperature of 1300° C.

According to a further embodiment of the invention, the material is held in the preheating stage for a time period of 0.1-60 seconds.

As will be evident from FIG. 2, the material is brought to its final temperature in roughly half the time compared with a conventional furnace with air as the oxidizing gas. When applying the method according to the present invention, the time taken to heat the material is shortened by roughly 50% in comparison with the time taken when applying the method according to the previously-identified patent.

The present invention thus provides a solution to the problem mentioned in the introduction.

Although the invention has been described above with reference to a number of embodiments thereof, it will be obvious to one skilled in this art that furnace designs, burner arrays, and the duration of the preheating stage will be adapted to the relevant application of use. Moreover, the preheating stage and the final heating stage can be combined in one single unit.

The present invention shall not therefore be considered as being limited to said embodiments, since modifications and variations can be made within the scope of the accompanying claims.

What is claimed is:

1. A method of heat treating stainless steel in the form of blanks, piping, tubing, strip or wire-like material, after rolling said material, and in a heat treatment furnace at a temperature higher than about 900° C., said method comprising the steps of: preheating the stainless steel to a temperature of 150-1000° C. in a first heating stage by flames from burners, wherein the flames are directed towards the surface of the material to impinge on the surface, wherein the burners situated in the preheating stage provide flames that are two-directional to impinge on opposite surfaces of the stainless steel and are supplied with a liquid or gaseous fuel that burns with the aid of an oxidizing gas that contains at least 85% gaseous oxygen by volume; holding the stainless steel during preheating for a first heating time period of 0.1-60 seconds to acquire on the surface of the stainless steel at least some degree of oxidation on the surface of the material to increase a surface emission factor and to provide a higher heat yield between a furnace atmosphere and the stainless steel during heating in a following final heating stage; and heating the stainless steel in a furnace in a following final heating stage for a second heating time by means of burners situated in a furnace and that are supplied with a liquid or a gaseous fuel and an oxidizing gas.

2. A method according to claim 1, wherein the oxidizing gas in the final heating step contains at least 85% oxygen by volume.

3. A method according to claim 1, including the step of bringing the stainless steel to a temperature of up to 1300° C. in the final heating step.

4. A method according to claim 1, wherein the second heating time is greater than the first heating time.

* * * * *